United States Patent [19]

Pare

[11] Patent Number: 4,506,737

[45] Date of Patent: Mar. 26, 1985

[54] FIRE SPRINKLER

[75] Inventor: Girard F. Pare, Auburn, Mass.

[73] Assignee: Daniel J. Donahue, North Hampton, N.H.

[21] Appl. No.: 497,903

[22] Filed: May 25, 1983

[51] Int. Cl.[3] ..... A62C 37/10

[52] U.S. Cl. ..... 169/19; 169/37

[58] Field of Search ..... 169/19, 20, 37, 42, 169/90, 5, 38, 39, 40, 41

[56] References Cited

U.S. PATENT DOCUMENTS

| | | | |
|---|---|---|---|
| 514,220 | 2/1894 | Gray . | |
| 884,430 | 4/1908 | Thornton et al. . | |
| 1,630,251 | 5/1927 | Bechard | 169/19 X |
| 1,984,067 | 12/1934 | Kennedy | 169/23 |
| 2,008,961 | 7/1935 | Lessard | 169/19 X |
| 2,324,170 | 7/1943 | Ofstie | 169/39 |
| 3,080,000 | 3/1963 | Gloeckler | 169/41 |
| 3,570,447 | 3/1971 | Basseches | 169/23 X |
| 3,664,430 | 5/1972 | Sitabkhan | 169/23 |
| 3,831,682 | 8/1974 | Calcaro | 169/37 |

*Primary Examiner*—Jeffrey V. Nase

[57] ABSTRACT

A combination sprinkler-valve that may be mounted in a water line in place of a conventional valve and that when so mounted will both control flow through the line and provide an anti-fire spray when needed. The sprinkler-valve includes a body one end of which is adapted for connection to a water line, a valve stem extending axially through the body for controlling flow through the water line, a handle attached to one end of the valve stem and valving surface at other end. A plurality of bores extend from the end of the valve body at the water line upwardly through said valve body so that water may flow from the water line through the bores, and a seal is removably positioned in each of the bores to prevent such flow. Temperature responsive means including a first element contacting the seal, a second portion contacting a fixed part of the valve, and a temperature responsive material securing said two elements together, retains the seals in the bores until a fire occurs.

19 Claims, 2 Drawing Figures

FIRE SPRINKLER

This invention relates to fire sprinklers.

It is a principal object of the present invention to provide a combination sprinkler-valve that may be mounted in a water line in place of a conventional valve and that when so mounted will both control flow through the line and provide an anti-fire spray when needed. Other objects include providing such a device that will provide a signal it has been triggered to provide anti-fire spray, and in which the anti-fire spray can easily be turned off when a fire has been controlled.

The invention features a sprinkler-valve including a body one end of which is adapted for connection to a water line, a valve stem extending axially through the body for controlling flow through the water line, a handle attached to one end of the valve stem and valving surface at other end. A plurality of bores extends from the end of the valve body at the water line upwardly through said valve body so that water may flow from the water line through the bores, and a seal is removably positioned in each of the bores to prevent such flow. Temperature responsive means including a first element contacting the seal, a second portion contacting a fixed part of the valve, and a temperature responsive material securing said two elements together, retains the seals in the bores until a fire occurs.

In preferred embodiments, there are three bores spaced at 120° intervals such the axis of each intersect the outer portion of the handle, a pin is slip-fitted in each bore, and the first element of the temperature responsive means engages the top of each pin.

Figure 1:
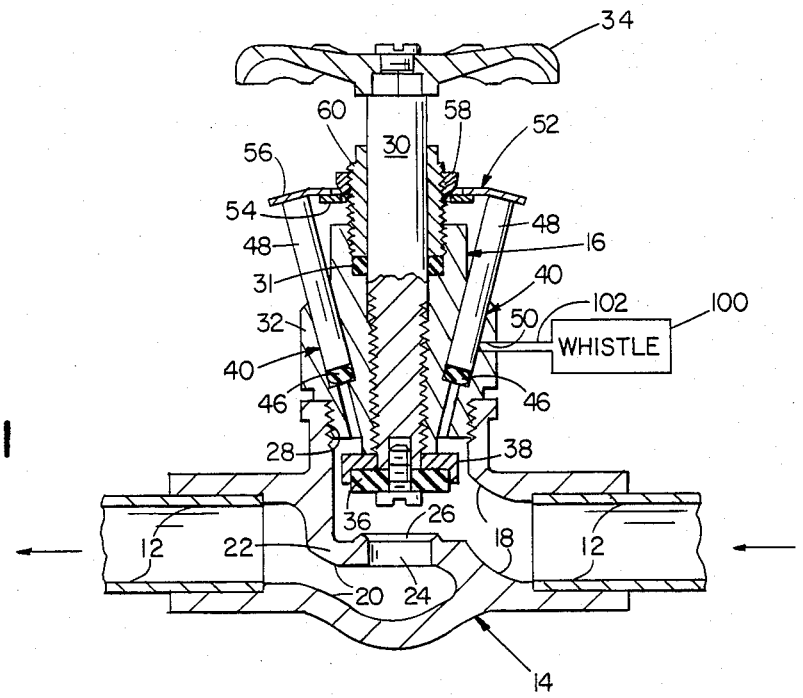
Figure 2:
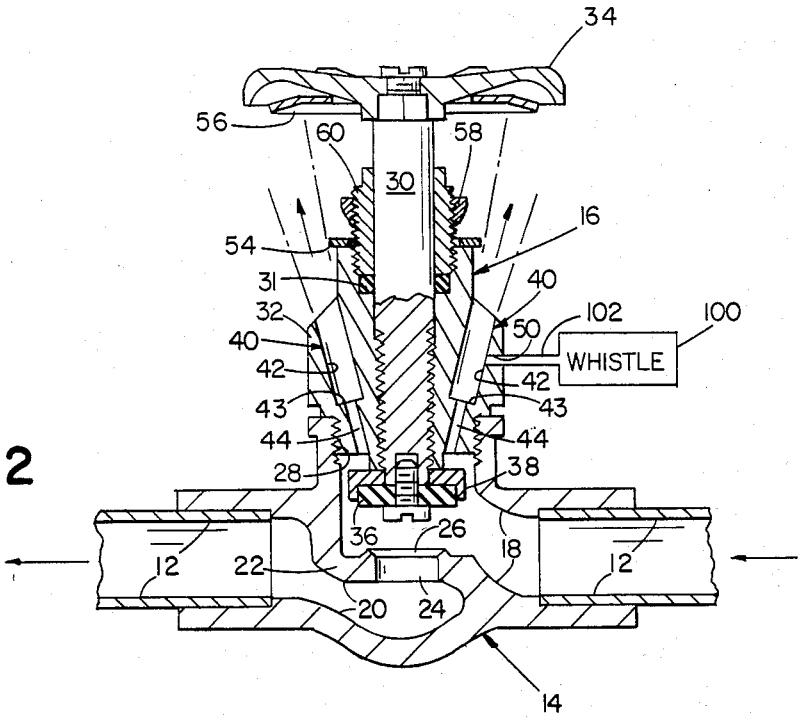

Other objects, features and advantages will appear from the following detailed description of a preferred embodiment of the invention, taken together with the attached drawings which are plan sectional views of a sprinkler-valve embodying the present invention, FIG. 1 showing the sprinkler-valve in its as-installed configuration and FIG. 2 showing the sprinkler-valve after a fire has been detected.

Referring now to the drawings, there is shown a sprinkler-valve, generally designated 10, mounted in a water line 12 in which water flow is in the direction indicated. Valve 10 includes a conventional valve seat structure 14 mounted in water line 12 into which is threaded a body structure 16.

The valve seat structure 14 includes an inlet chamber 18 and outlet chamber 20, each receiving an adjacent end of water line 22 and separated by a horizontal dividing wall 22. A flow port 24 extends through dividing wall 22, with the top of port 24 defining a valve seat 26 adapted to receive a conventional sealing washer. Body structure 16 is threaded into a bore 28 in the top of inlet chamber 18, the axis of the bore 28 being coaxial with that of flow port 24.

Body structure 16 comprises a conventional valve stem 30 threaded centrally through a body 32 and having, at its opposite ends, a handle 34 and a sealing washer 36. An O-ring 31 forms a circumferential seal between the stem 30 and the body 32. Sealing washer 36 is mounted in a washer retainer 38 and is held in place by a retaining screw, in the conventional manner. As will be evident, and conventional, sealing washer 36 is adapted to seat on valve seat 26 (and thus prevent flow through port 24) when the valve is closed, and to be spaced above valve seat 26 (as shown in the drawings, and thus permit flow from inlet chamber into outlet chamber 20) when the valve is open.

As thus far described, valve seat structure 14 and body structure 16 are conventional, and essentially identical to the structure of a conventional gate valve.

Additionally, valve body 32 includes three drilled sprinkler holes, generally designated 40 and spaced circumferentially of the axis of valve stem 30 at 120 degree intervals. For clarity, the drawings show two holes 40, pins 48, and seals 46 displaced from their actual positions.

As shown, each sprinkler hole 40 extends from the bottom of the valve body 32 (where it communicates with inlet chamber 18 of valve structure 14) upwardly through the valve body forming an acute angle (preferably less than about 30° and, as shown, about 15°) with the valve stem axis, exiting through the side of the valve body. The upper portion 42 of each hole 40 has a diameter of about 0.140 in., and is axially aligned with an lower portion 44 having a diameter of about 0.0625 in. (1/16 in.). An annular seat 43 is provided between the upper and lower portions, and a rubber seal 46 (in the illustrated embodiment a neoprene ball ⅛ in. in diameter) fits within upper portion 42 and seats on seat 43 to prevent flow from lower portion 44.

An activator pin 48 (in the illustrated embodiment an aluminum rod ⅛ in. in diameter) is slip-fitted in the upper portion 42 of each sprinkler hole 40 with its lower end abutting seal 46 and its upper end extending upwardly out of hole 40. A whistle hole 50, 1/16 in. in diameter, extends from one of sprinkler holes 40 generally radially outwardly through the wall of body 32. A swaged tubing 102 connects the whistle hole to an industrial whistle 100 (as shown of the type sold by Proll Molding Co. of Bloomfield, N.J.).

The upper end of each pin 48 abuts a sacrificial trigger, generally designated 52. As shown, trigger 52 comprises a pair of steel washers 54, 56 the overlapping face portions of which are bonded together with a low melt point alloy (in the illustrated embodiment, a low melt paste provided by Turbo Braze Corp. of Union, N.J. and having a melting point between 155 and 160 degrees F.) Trigger 52 is held in place by a link nut 58 threaded over the packing nut 60 of valve 10. The underside of link nut 58 has been beveled at a 45° angle (preferably the bevel is cut in the outwardly convex configuration of a spherical zone), and the bevel engages the edge of the central hole through washer 54. As link nut 58 is tightened down, trigger 52 forces activator pins 48 down into holes 40, thereby tightly sealing seals 46 against the bottoms of upper hole portions 42. Clearance is provided between the underside of trigger 52 and the top of valve body 32, so that the spherical-zone configured bevel on the underside of nut 58 will permit the trigger to shift (e.g., to tilt slightly relative to the valve axis) as required to take up minor differences in length of the different activator pins and, when seated, provide substantially equal force on all three pins.

The angular orientation of the pins 48 is such that the extended axis of each pin (and also the extended axis of holes 40) intersects handle 34 adjacent the handle periphery. The overall length of each pin 48 is less than the distance from the top of hole 40 to handle 34.

In operation, sprinkler-valve 10 is mounted in a water line in the usual manner, and the device is regularly used as a valve (by turning handle 34) to control flow through water line 12.

If a fire should occur, the heat will melt the low melt point alloy holding the two washers 54, 56 of trigger 52 together. As shown in FIG. 2, water under pressure in inlet chamber 18 flows through the lower portion 44 of holes 40 and blows seals 46 and pins 48 upwardly out of holes 40. A high pressure stream of water then will flow out of each hole 40, driving the larger diameter washer 56 of trigger 52 up against the underside of handle 34 while the smaller diameter washer 54 drops onto the top of body 32. The water from holes 40 impacts on the washer 56 and the bottom periphery of handle 34, thereby dispersing the water streams into sprays.

The flow of water through the hole 40 intersected by whistle hole 50 produces a pressure drop in hole 50 (typically about 1½ to 3 in. of water below atmospheric), and this relative vacuum energizes whistle 100 and produces an audible signal.

OTHER EMBODIMENTS

In other embodiments, whistle 100 (or some other pressure-activated device) may energize an electrical switch which, in turn, may be connected to a distant alarm or to other fire-fighting equipment.

Also, low melt alloys having melting points ranging from about 135 to about 270 degrees are generally available. The particular alloy used in the sprinkler-valve of the present invention will depend on the intended use of the device, a higher temperature alloy being used when the sprinkler-valve is to be used in a location (such as an unventilated attic) where high temperatures may occur normally.

These and other embodiments will be within the scope of the following claims.

What is claimed is:

1. In a valve comprising a valve body having one cavity which is adapted for connection to an inlet line through which liquid may flow into said valve and another cavity which provides an outlet through which liquid may flow from said valve, a valve stem extending axially through said body and movable axially relative to said body for controlling flow through a port within said body intermediate said one cavity and said another cavity, said valve stem having a handle attached to one end thereof and defining a valving surface at the other end thereof, that improvement comprising:

a plurality of bores extending from said one cavity of said valve body through said valve body generally towards said valve handle and at an acute angle to the axis of said valve stem;

a seal removably positioned in each of said bores to prevent flow of liquid from said inlet line therethrough, and temperature responsive means retaining said seals in the respective ones of said bores, said means including a first element contacting said seal, a second element contacting a member fixed with respect to said valve body, and a temperature responsive material securing said first element to said second element, said material being adapted to release said second element from said first element when said temperature is above a predetermined temperature and thereby permit liquid from said inlet line to force said seals from said bores and permit flow of liquid from said inlet line outwardly from said valve body through said bores.

2. The valve of claim 1 wherein each of said bores includes upper and lower axially aligned, circular in cross-section bore portions, each said seal includes a circular in cross-section pin having a diameter slightly less than and fitted within one of said upper bore portions with one end thereof adjacent the intersection of said upper and lower portions of said one bore, and first element of said temperature responsive means engages the other end of said pin.

3. The valve of claim 2 including three of said bores and a said seal positioned within each of said bores.

4. The valve of claim 3 wherein said bores are spaced circumferentially of said axis of said valve body at approximately 120 degree intervals.

5. The valve of claim 2 wherein the intersection of said upper and lower portions of each of said bores defines an annular step, each said seal includes a resilient sealing element, and each said pin forces a said seal against said step.

6. The valve of claim 1 wherein the axes of said bores are arranged such that extensions of said axes intersect said handle.

7. The valve of claim 1 wherein said second element defines a circular central hole therethrough surrounding said stem and contacting said portion of said valve.

8. The valve of claim 1 wherein said portion of said valve defines an outwardly convex spherical zone engaging said hole of said second element.

9. The valve of claim 1 including a hole of relatively small diameter extending generally outwardly from one of said bores, and means connected to said hole for sensing flow of water therethrough.

10. The valve of claim 9 including a whistle connected to said hole.

11. The valve of claim 1 including three of said bores and a said seal positioned within each of said bores.

12. The valve of claim 11 wherein said bores are spaced circumferentially of said axis of said valve body at approximately 120 degree intervals.

13. The valve of claim 12 wherein the axes of said bores are arranged such that extensions of said axes intersect said handle.

14. The valve of claim 12 wherein said second element defines a circular central hole therethrough surrounding said stem and contacting said portion of said valve.

15. The valve of claim 14 wherein said portion of said valve defines an outwardly convex spherical zone engaging said hole of said second element.

16. In a valve comprising a valve body having one cavity which is adapted for connection to an inlet line through which liquid may flow into said valve and another cavity which provides an outlet through which liquid may flow from said valve, a valve stem extending axially through said body and movable axially relative to said body for controlling flow through a port within said body intermediate said one cavity and said another cavity, said valve stem having a handle attached to one end thereof and defining a valving surface at the other end thereof, that improvement comprising:

an anti-fire liquid flow bore extending from said one cavity of said valve body through said valve body;

a seal removably positioned in said bore to prevent flow of liquid from said inlet line therethrough, and temperature responsive means retaining said seal in said bore, said means including a first element contacting said seal, a second element contacting a member fixed with respect to said valve body, and a temperature responsive material securing said first element to said second element, said material being adapted to release said second element from said first element when said temperature is above a predetermined temperature and thereby permit liquid from said inlet line to force said seal from said bore and permit flow of liquid from said inlet line outwardly from said valve body through said bore.

17. The valve of claim 16 including a plurality of said bores each extending through said valve body.

18. The valve of claim 17 wherein each of said bores extends through said valve body generally towards said handle.

19. The valve of claim 17 wherein each of said bores extends through said valve body at an acute angle to the axis of said valve stem.

* * * * *